US011583063B2

(12) United States Patent
Holman

(10) Patent No.: US 11,583,063 B2
(45) Date of Patent: Feb. 21, 2023

(54) HAIR SCULPTING DEVICE

(71) Applicant: Mario Edward Holman, Durham, NC (US)

(72) Inventor: Mario Edward Holman, Durham, NC (US)

( * ) Notice: Subject to any disclaimer, the term of this patent is extended or adjusted under 35 U.S.C. 154(b) by 532 days.

(21) Appl. No.: 16/681,173

(22) Filed: Nov. 12, 2019

(65) Prior Publication Data

US 2020/0146430 A1 May 14, 2020

Related U.S. Application Data

(60) Provisional application No. 62/767,075, filed on Nov. 14, 2018.

(51) Int. Cl.
*A46B 9/02* (2006.01)

(52) U.S. Cl.
CPC ..... *A46B 9/028* (2013.01); *A46B 9/023* (2013.01); *A46B 2200/104* (2013.01)

(58) Field of Classification Search
CPC .... A46B 9/028; A46B 9/023; A46B 2200/104
See application file for complete search history.

(56) References Cited

U.S. PATENT DOCUMENTS

| | | | | |
|---|---|---|---|---|
| 2,497,209 | A * | 2/1950 | Davitcho | A46B 9/023 132/142 |
| 8,181,304 | B1 * | 5/2012 | Kamath | A46B 9/028 D4/133 |
| 8,220,100 | B2 | 7/2012 | Diamond | |
| 8,397,336 | B2 | 3/2013 | Park | |
| 8,656,933 | B2 | 2/2014 | Boyd | |
| 8,764,119 | B2 | 7/2014 | Hobbs | |
| 9,924,788 | B2 | 3/2018 | Schuster | |
| 10,390,605 | B1 * | 8/2019 | Schechter | A01K 13/002 |
| 2002/0066150 | A1 * | 6/2002 | Bigio | A46B 9/023 D4/133 |
| 2004/0255967 | A1 * | 12/2004 | White | A46B 9/023 132/120 |
| 2007/0022551 | A1 * | 2/2007 | Kuo | A46B 9/028 15/159.1 |
| 2008/0163886 | A1 * | 7/2008 | Wang | A45D 24/00 15/207.2 |
| 2011/0056505 | A1 * | 3/2011 | Parkinson | A46B 9/028 15/160 |
| 2018/0295978 | A1 * | 10/2018 | Kim | A46D 1/0261 |

FOREIGN PATENT DOCUMENTS

| | | | | |
|---|---|---|---|---|
| CN | 209073632 U * | 7/2019 | | A45D 24/16 |
| DE | 202017107726 U1 * | 4/2018 | | A46B 15/00 |

* cited by examiner

*Primary Examiner* — Shay Karls
(74) *Attorney, Agent, or Firm* — Tyrrell Ufot; NCCU IP Clinic

(57) ABSTRACT

A hair sculpting device that creates a wave-like pattern of hair by utilizing a plurality of long and short bristles in a repeating pattern, while penetrating the user's scalp to release oils that cultivate hair follicles in a wave like pattern.

9 Claims, 5 Drawing Sheets

| | Column 1 | Column 2 | Column 3 | Column 4 | Column 5 | Column 6 | Column 7 |
|---|---|---|---|---|---|---|---|
| Row 1 | 10mm | 5mm | 10mm | 5mm | 10mm | 5mm | 10mm |
| Row 2 | 9-7mm | 5mm | 9-7mm | 5mm | 9-7mm | 5mm | 9-7mm |
| Row 3 | 6-5mm | 5mm | 6-5mm | 5mm | 6-5mm | 5mm | 6-5mm |
| Row 4 | 5mm | 5mm | 5mm | 5mm | 5mm | 5mm | 5mm |
| Row 5 | 5-6mm | 5mm | 5-6mm | 5mm | 5-6mm | 5mm | 5-6mm |
| Row 6 | 7-9mm | 5mm | 7-9mm | 5mm | 7-9mm | 5mm | 7-9mm |
| Row 7 | 10mm | 5mm | 10mm | 5mm | 10mm | 5mm | 10mm |
| Row 8 | 9-7mm | 5mm | 9-7mm | 5mm | 9-7mm | 5mm | 9-7mm |
| Row 9 | 6-5mm | 5mm | 6-5mm | 5mm | 6-5mm | 5mm | 6-5mm |
| Row 10 | 5mm | 5mm | 5mm | 5mm | 5mm | 5mm | 5mm |
| Row 11 | 5-6mm | 5mm | 5-6mm | 5mm | 5-6mm | 5mm | 5-6mm |
| Row 12 | 7-9mm | 5mm | 7-9mm | 5mm | 7-9mm | 5mm | 7-9mm |

HAIR SCULPTING DEVICE

CROSS-REFERENCE TO RELATED APPLICATIONS

This application claims the benefit of U.S. Provisional Application No. 62/767,075, filed Nov. 14, 2018, which is hereby incorporated in its entirety.

FIELD OF THE INVENTION

The present invention relates to a hair sculpting device. More particularly, the invention relates to a hair sculpting device that cultivates hair follicles while creating a wave-like pattern in a user's hair.

BACKGROUND

The following description is not an admission that any of the information provided herein is prior art or relevant to the present invention, or that any publication specifically or implicitly referenced is prior art. Any publications cited in this description are incorporated by reference herein. Where a definition or use of a term in an incorporated reference is inconsistent or contrary to the definition of that term provided herein, the definition of that term provided herein applies and the definition of that term in the reference does not apply.

A hairbrush is a stick brush with rigid or soft bristles used in hair care for smoothing, styling, and detangling human hair, or for grooming an animal's fur. It can also be used for styling in combination with a curling iron or a hair dryer. Proper hair brushing and scalp massaging are two of the most important elements in the maintenance and rejuvenation of healthy hair. Most hair sculpting devices such as hairbrushes can be quite damaging to one's hair. Furthermore, brushing with synthetic bristles causes friction on hair, leading to cuticle damage and breakage. In addition, many individuals prefer to use hair sculpting devices that are healthy to their hair while producing some waves in hair. However, too much brushing can cause the hair to become thinner. Furthermore, excessive brushing of one's hair does not create a wave like pattern. One goal is to produce waves in the hair, yielding thick and healthy-looking hair. Currently, hair sculpting devices use bristles that are manufactured for purposes of causing hair follicles to lay flat after brushing. These are conventional brushes that accomplish the task of detangling hair, but typically these brushes do not provide all the benefits that one may desire in a brush, such as penetrating the scalp, promoting the distribution of oils in the hair for even growth, and creating wave-like pattern styling.

Therefore, there exists a need for a hair sculpting device, that without adding additional products can allow consumers to brush hair to create a wave-like pattern while also penetrating the scalp to release and promote oil distribution from the brush without incorporating secondary materials.

SUMMARY OF THE INVENTION

The present invention is directed to a hair sculpting device that creates a wave-like pattern in a user's hair. The device may be used by professional barbers, stylists, and individual consumers. The device comprises a plurality of bristles of different lengths configured to create a wave-like pattern in the user's hair without the need to over-brush which can lead to thinning of the user's hair. In an exemplary embodiment, the plurality of bristles is made from boar bristles. Hair brushing with a boar bristle brush stimulates the capillaries, increases blood circulation in the scalp, and transports oxygen and nutrients to the hair stem, root and bulb. It also helps to balance the sebaceous glands by stimulating them and allowing them to breathe while retaining their natural oils.

In another embodiment of the invention, the sculpting device comprises a handle, and a head portion. In one embodiment, the handle and the head portion are made of oak, pine, or *cannabis* wherein the bristles are soaked in coconut oil for at least 24 hours prior to distribution.

Additionally, another embodiment of this invention is the utilization of a plurality of apertures holding the bristles cultivating and penetrating the hair follicles to create a wave like pattern while brushing due to the design of the bristles.

In one embodiment, a wave-like bristle hair sculpting device comprises a handle, and a head portion having a top surface and a bottom surface, wherein the top surface contains a plurality of apertures, wherein the plurality of bristles protrudes through the plurality of apertures, and wherein the plurality of bristles is arranged to form a repeating pattern of short bristles, medium bristles, and long bristles configured to create a wave-like pattern in a user's hair.

In yet another embodiment, the head portion and the handle comprise a woody material. In another embodiment, the woody material comprises oak, pine, or *cannabis*, or any combination thereof.

In still another embodiment, the plurality of bristles comprises boar hair, bristle bird hair, porcupine hair, trinity snail hair, or any combination thereof.

In one embodiment, the hair sculpting device, further comprises about 70 to 90 apertures and about 30 to 40 bristles in the head portion.

In a further embodiment, the head portion is about 2 to 4 inches wide.

In another embodiment, the handle of the device is about 2 to 4 inches wide and about 6 to 8 inches long.

In yet another embodiment, the device is soaked in oil for about 24 hours to wet the plurality of bristles with oil.

In one embodiment, the device is configured to provide different lengths of bristles to cause different orientation of hair follicles.

In another embodiment, a wave-like bristle hair sculpting device comprises a handle, and a head portion having a top surface and a bottom surface, wherein the top surface contains a plurality of apertures, wherein the plurality of bristles protrude through the plurality of apertures, wherein the plurality of bristles are arranged to form a repeating pattern of short bristles, medium bristles, long bristles configured to create a wave-like pattern in a user's hair, and wherein the head portion and the handle comprise a woody material.

In yet another embodiment, the woody material comprises oak, pine, or *cannabis*, or any combination thereof.

In a further embodiment, the plurality of bristles comprises boar hair, bristle bird hair, porcupine hair, trinity snail hair, or any combination thereof.

In another embodiment, the device further comprises about 70 to 90 apertures and about 30 to 40 bristles in the head portion.

In a further embodiment, the head portion is about 2 to 4 inches wide.

In an embodiment, the handle is about 2 to 4 inches wide and about 6 to 8 inches long.

In still another embodiment, the device is soaked in oil for about 24 hours to wet the plurality of bristles with oil.

In one embodiment, the device is configured to provide different lengths of bristles to cause different orientation of hair follicles.

Various objects, features, aspects and advantages of the inventive subject matter will become more apparent from the following detailed description of exemplary embodiments, along with the accompanying figures in which like numerals represent like components.

DETAILED DESCRIPTION

As used in the description herein and throughout the claims that follow, the meaning of "a," "an," and "the" includes plural reference unless the context clearly dictates otherwise.

As used herein, the term "about" in conjunction with a numeral refers to a range of that numeral starting from 10% below the absolute of the numeral to 10% above the absolute of the numeral, inclusive.

As used herein, and unless the context dictates otherwise, the term "hair sculpting device" is intended to include both a brush and a device. Therefore, the terms "hair sculpting device," "brush," and "device" may be used interchangeably.

The present invention relates to a hair sculpting device used to style hair in a wave-like pattern while penetrating the scalp to distribute oil throughout the hair follicles. The device is configured to provide different lengths of bristles such that when a user is employing the device to her/his hair, the different bristle levels cause varying (different) orientation of hair follicles so they won't lay flat rather create a wavelike pattern in the user's hair.

Figure 1:
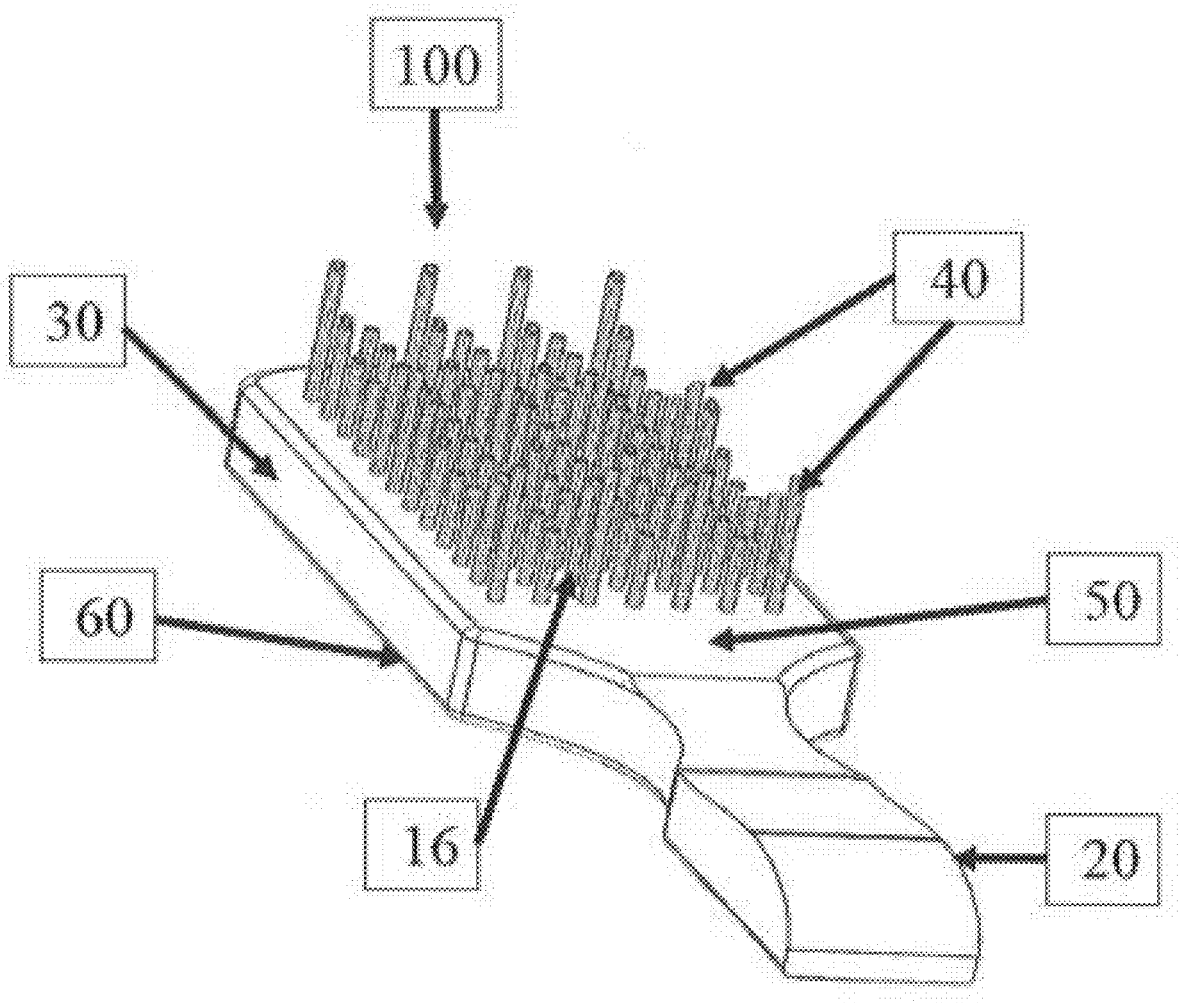
FIG. 1 depicts a top view of one exemplary embodiment of a hair sculpting device.
Figure 2:
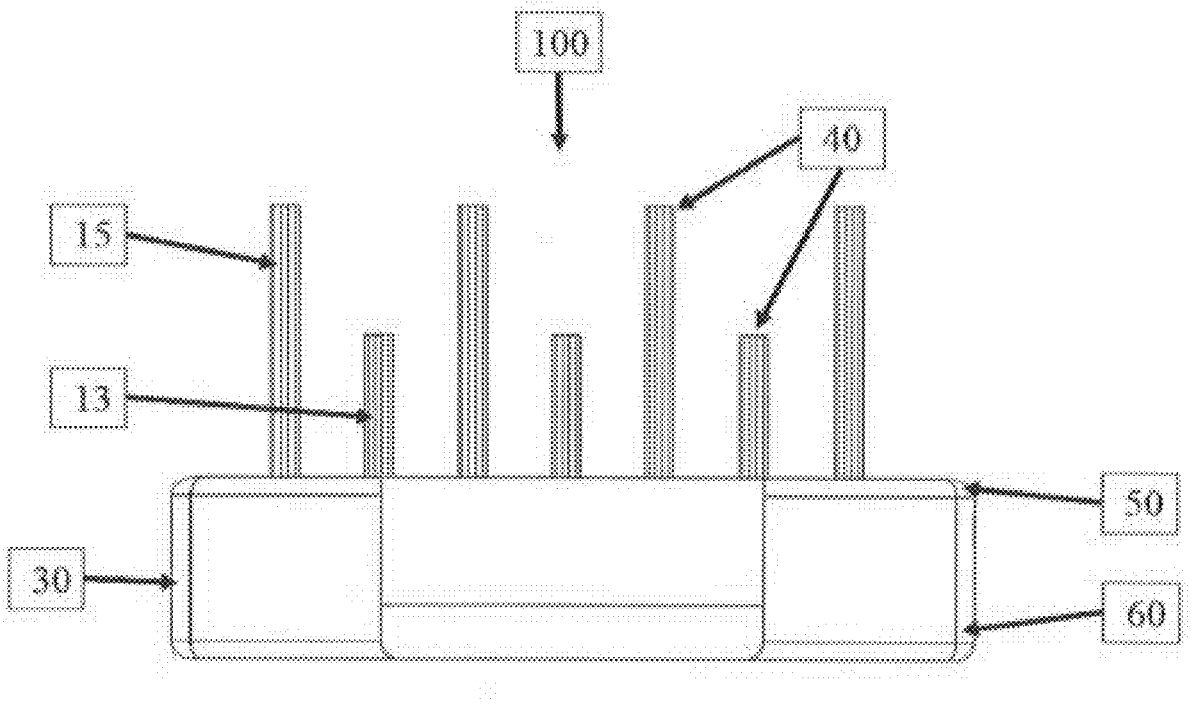
FIG. 2 depicts a side view of one exemplary embodiment of the bristles of a hair sculpting device.
Figure 3:
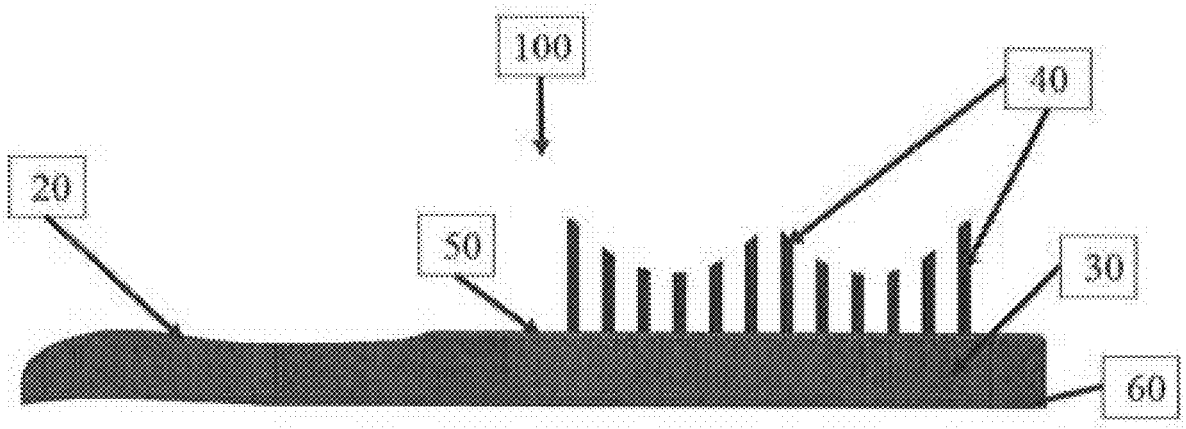
FIG. 3 depicts a side view of one embodiment of a hair sculpting device.

FIGS. 1-3 are exemplary embodiments of hair sculpting device 100. In one exemplary embodiment, device 100 comprises handle 20, head portion 30, wherein head portion 30 comprises top surface 50, bottom surface 60, and plurality of apertures 16, wherein plurality of apertures 16 comprise plurality of bristles 40. In one embodiment, top surface 50 is flat. In another embodiment, plurality of bristles 40 protrudes through plurality of apertures 16 in flat surface 50 of head portion 30. Handle 20 is integrally attached to head portion 30. In one embodiment, plurality of bristles 40 comprises bristles of different lengths. In an exemplary embodiment, short bristles 13 are about 4 mm to 7 mm long, medium bristles 14 are about 6 mm to 9 mm long, and long bristles 15 are about 8 mm to 11 mm long. In one embodiment, top surface 50 comprises about 70 to 90 apertures. In one exemplary embodiment, head portion 30 is configured to hold about 25 to 40 bristles. One of ordinary skill in the art will readily appreciate other lengths and different number of bristles based on the dimensions of device 100.

Figure 4:
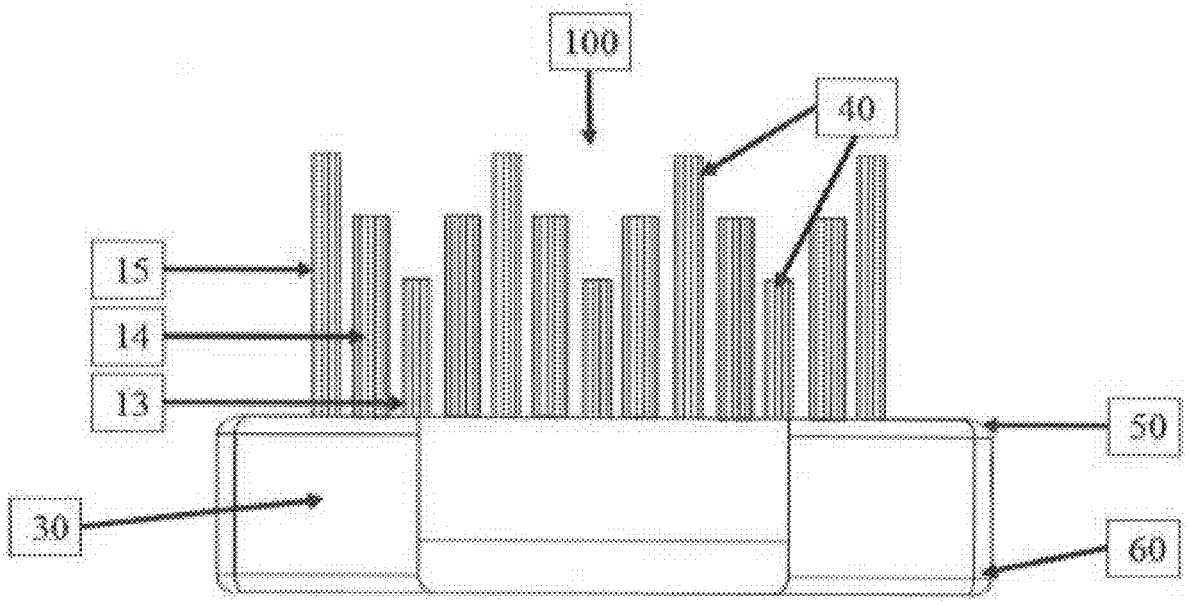
FIG. 4 depicts a side view of one exemplary embodiment of the bristles of a hair sculpting device.

In an embodiment, plurality of bristles 40 comprises bristles of differing lengths arranged to form a repeating pattern of short bristles 13, medium bristles 14, and long bristles 15, wherein short bristles 13, medium bristles 14 and long bristles 15 comprise a wave like pattern, as depicted in FIGS. 1 and 3. In another embodiment, short bristles 13, medium bristles 14, and long bristles 15 comprise a random pattern (not shown). In yet another embodiment, short bristles 13, medium bristles 14, and long bristles 15 comprise a staggered pattern, wherein short bristles 13 are always shorter than medium bristles 14, and medium bristles 14 are always shorter than long bristles 15 (see FIG. 1). In another embodiment, plurality of bristles 40 are arranged in a single row with long bristles 15 next to medium bristles 14, which in turn are adjacent to short bristles 13 and this pattern of bristles (i.e., long next to medium next to short) is repeated throughout device 100. Such rows are arranged side-by-side to create a wave-like pattern as depicted in FIG. 4.

Figures 5, 5A:
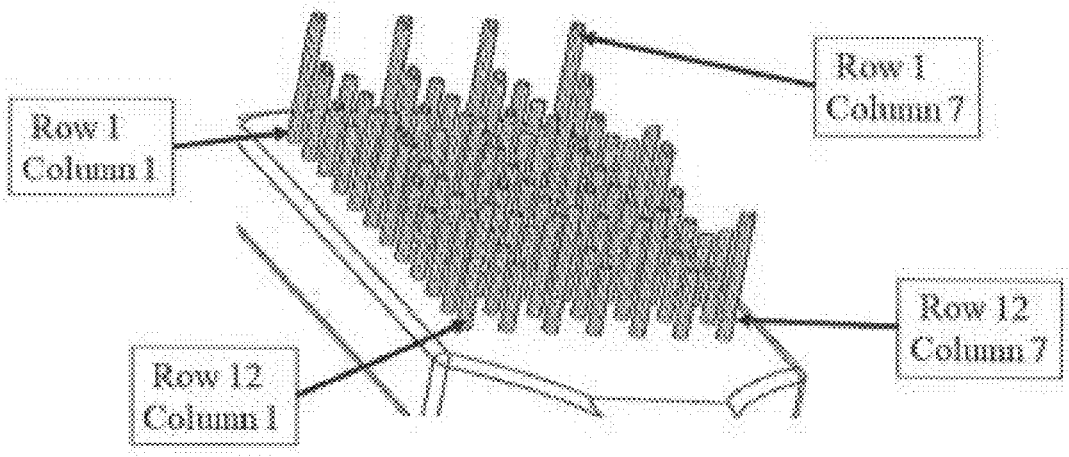
FIG. 5 depicts a representation of the bristle length configuration exemplified in FIG. 5*a*.
FIG. 5*a* depicts the bristle length configuration of an exemplary embodiment.

FIG. 5*a* depicts the collective bristle height of an exemplary embodiment wherein short bristles 13, medium bristles 14, and long bristles 15 comprise a specific collective height to enable a user to create a wave-like pattern. As provided in FIG. 5*a*, plurality of apertures 16 are arranged in a symmetrical pattern comprising twelve rows and seven columns (see FIG. 5). As illustrated in FIG. 5, in an embodiment, Row 1 column 1 comprises plurality of bristles 40 wherein the collective height of bristles 40 is 10 mm. In this embodiment, Row 2 column 1 comprises plurality of bristles 40 wherein the collective height of bristles 40 is 7 to 9 mm.

In an embodiment, handle 20 and head portion 30 are manufactured from wood such as oak, pine, or other woody material, or any combination thereof. In an embodiment, head portion 30 is about 2 to 4 inches wide. In yet another embodiment, handle 20 is about 2 to 4 inches wide and about 6 to 8 inches in length.

In an embodiment, head portion 30 is soaked in canola oil for 24 hours to condition plurality of bristles 40. In one embodiment, plurality of bristles 40 are manufactured from material such as boar hair, bristle bird hair, porcupine hair, trinity snail hair, or any combination thereof.

Thus, specific embodiments of a hair sculpting device and a method to employ such device for brushing to release oils while creating a wave-like pattern have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A wave-like bristle hair sculpting device comprising:

(a) a handle, and (b) a head portion having a top surface and a bottom surface, wherein said top surface contains a plurality of apertures, wherein a plurality of bristles protrudes through said plurality of apertures, and wherein said plurality of bristles are arranged to form a repeating pattern comprising short bristles, medium bristles, and long bristles along the lateral direction of said device; and wherein said repeating pattern is configured to create a wave-like pattern of only two sequential concave formations along the longitudinal direction of said device.

2. The hair sculpting device of claim 1, wherein said head portion and said handle comprise a woody material.

3. The hair sculpting device of claim 2, wherein said woody material comprises oak, pine, or *cannabis*, or any combination thereof.

4. The hair sculpting device of claim 1, wherein said plurality of bristles comprise boar hair, bristle bird hair, porcupine hair, trinity snail hair, or any combination thereof.

5. The hair sculpting device of claim 1, further comprising about 70 to 90 apertures and about 30 to 40 bristles in said head portion.

6. The hair sculpting device of claim 1, wherein said head portion is about 2 to 4 inches wide.

7. The hair sculpting device of claim 1, wherein said handle is about 2 to 4 inches wide and about 6 to 8 inches long.

8. The hair sculpting device of claim 1, wherein said device is soaked in oil for about 24 hours to wet said plurality of bristles with oil.

9. The sculpting device of claim 1 configured to provide different lengths of bristles to cause different orientation of hair follicles.

* * * * *